US010563606B2

(12) United States Patent
Magner et al.

(10) Patent No.: US 10,563,606 B2
(45) Date of Patent: Feb. 18, 2020

(54) POST CATALYST DYNAMIC SCHEDULING AND CONTROL

(75) Inventors: Stephen William Magner, Farmington Hills, MI (US); Mrdjan J. Jankovic, Birmingham, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 2230 days.

(21) Appl. No.: 13/410,159

(22) Filed: Mar. 1, 2012

(65) Prior Publication Data

US 2013/0231846 A1 Sep. 5, 2013

(51) Int. Cl.

*F02D 41/18* (2006.01)
*F02D 41/14* (2006.01)
*F02D 41/00* (2006.01)

(52) U.S. Cl.

CPC ..... *F02D 41/182* (2013.01); *F02D 41/1441* (2013.01); *F02D 41/1454* (2013.01); *F02D 41/1455* (2013.01); *F02D 41/1456* (2013.01); *F01N 2550/02* (2013.01); *F01N 2560/025* (2013.01); *F02D 41/0072* (2013.01); *F02D 41/14* (2013.01)

(58) Field of Classification Search

CPC ..... F02D 41/0072; F02D 35/0035; F02D 35/0092; F02D 41/1441; F02D 41/14; F02D 41/182; F02D 41/1455; F02D 41/1456; F02D 41/1454; F02M 25/0754; F01N 2560/025; F01N 2550/02

USPC ..... 701/108; 436/37, 137; 60/274, 276, 277, 60/285; 123/491, 492

See application file for complete search history.

(56) References Cited

U.S. PATENT DOCUMENTS 4,733,358 A * 3/1988 Abthoff ..... F02D 41/1441 123/675
4,854,288 A * 8/1989 Uchikawa ..... F02D 41/1441 123/682
5,099,647 A * 3/1992 Hamburg ..... 60/274
5,359,853 A * 11/1994 Shimizu ..... F01N 11/007 123/703
5,432,701 A * 7/1995 Mayer ..... B60G 17/0195 123/478
5,842,340 A * 12/1998 Bush ..... F01N 11/007 60/274
6,594,986 B2 7/2003 Ingram et al.
6,850,165 B2 2/2005 Sakanushi et al.
6,904,355 B2 * 6/2005 Yasui ..... F02D 41/1402 123/90.11

(Continued)

OTHER PUBLICATIONS

Wells Counter Point, Getting the Flow of MAF Sensors, Apr. 1999, vol. 3 Issue 2, pp. 3-4.*

(Continued)

*Primary Examiner* — Mahmoud Gimie
*Assistant Examiner* — Joshua Campbell
(74) *Attorney, Agent, or Firm* — Geoffrey Brumbaugh; McCoy Russell LLP

(57) ABSTRACT

A method is provided for controlling an engine exhaust with an upstream sensor and a downstream sensor. The method comprises adjusting a set-point for the downstream sensor based on a rate of change of air mass flow upstream of the engine and adjusting fuel injection to control exhaust fuel-air ratio (FAR) at the downstream sensor to the adjusted set-point, and to control exhaust FAR at the upstream sensor to an upstream sensor set-point.

18 Claims, 5 Drawing Sheets

(56) References Cited

U.S. PATENT DOCUMENTS

| | | | | |
|---|---|---|---|---|
| 6,945,033 | B2 * | 9/2005 | Sealy | F02D 41/1441 60/274 |
| 6,990,953 | B2 * | 1/2006 | Nakahara | F02D 11/105 123/339.16 |
| 7,198,952 | B2 | 4/2007 | Uchida et al. | |
| 2003/0150209 | A1 * | 8/2003 | Schnaibel | F02D 41/0295 60/285 |
| 2004/0128983 | A1 | 7/2004 | Okada et al. | |
| 2005/0022512 | A1 * | 2/2005 | Shirakawa | F01N 3/0814 60/285 |
| 2005/0096835 | A1 * | 5/2005 | Piwonka | F02D 41/18 701/115 |
| 2007/0234708 | A1 * | 10/2007 | Jones | F01N 11/00 60/277 |
| 2008/0066727 | A1 * | 3/2008 | Kato | F02D 41/2461 123/703 |
| 2009/0266052 | A1 * | 10/2009 | Rajagopalan | F02D 41/1454 60/276 |
| 2011/0083425 | A1 | 4/2011 | Sealy et al. | |

OTHER PUBLICATIONS

Motorera Dictionary of Automotive Terms—'Al,' Air Mass Flow, <http://www.motorera.com/dictionary/ai.htm>, Date Accessed: Jul. 31, 2014.*

* cited by examiner

POST CATALYST DYNAMIC SCHEDULING AND CONTROL

FIELD

The present disclosure relates to controlling an engine exhaust with sensors provided both upstream and downstream of a catalyst.

BACKGROUND AND SUMMARY

Catalytic converters may be provided to control exhaust emissions for a vehicle, however as the fuel-to-air ratio of the vehicle varies to rich or lean conditions, the state of the catalyst may decrease its effectiveness in preventing harmful emissions, such as CO or NOx from entering the atmosphere. Oxygen sensors may be provided to determine the state of a catalyst; however, this may not provide a quick response to dynamic operation state changes, resulting in harmful emissions being released during transitional operation states.

The inventors have recognized the issues with the above approach and offer a method and system to at least partly address them. In one embodiment, a method is provided for controlling an engine exhaust with an upstream sensor and a downstream sensor. The method comprises adjusting a set-point for the downstream sensor based on a rate of change of air mass flow upstream of the engine and adjusting fuel injection to control exhaust fuel-air ratio (FAR) at the downstream sensor to the adjusted set-point, and to control exhaust FAR at the upstream sensor to an upstream sensor set-point.

In this way, the catalyst state can be monitored and fuel injection can be adjusted to ensure the catalyst does not exceed a threshold amount of oxidants or reductants by predicting probable lean or rich FAR conditions. The present disclosure may offer several advantages. For example, preventing catalyst oxidant or reductant saturation reduces CO and NOx emissions and enhances fuel economy.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

The present disclosure provides a method and system for controlling a fuel-to-air ratio in a vehicle by adjusting fuel injection based on oxygen sensor feedback loops that provide information regarding a catalyst state. In this way, harmful emissions, such as CO and NOx, may be reduced and fuel economy may be enhanced.

Figure 1:
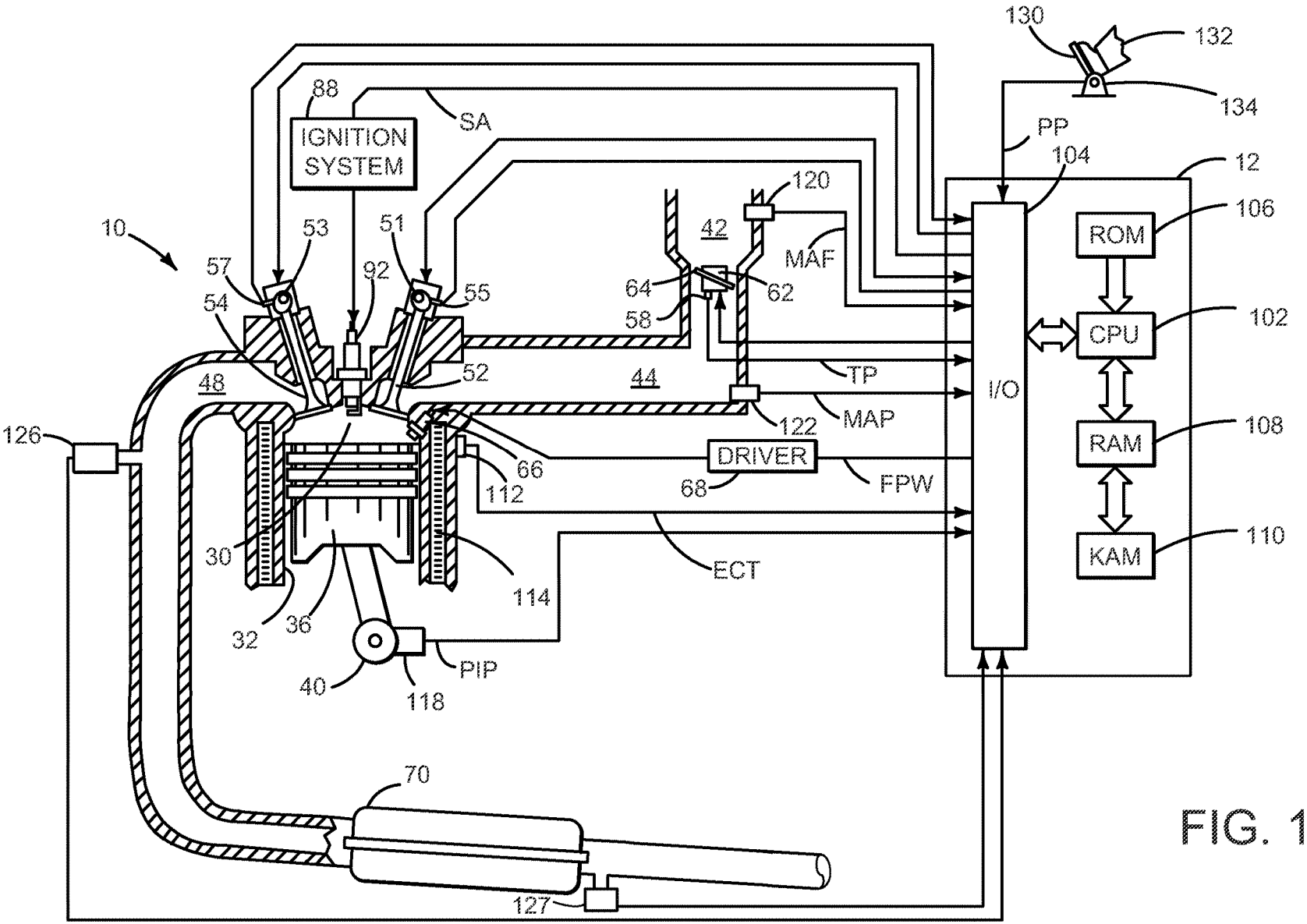
FIG. 1 shows a schematic diagram of a standard engine including an upstream UEGO sensor loop, a downstream HEGO sensor loop, and a controller element.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The position of intake cam 51 may be determined by intake cam sensor 55. The position of exhaust cam 53 may be determined by exhaust cam sensor 57.

Intake manifold 44 is also shown coupled to the engine cylinder having fuel injector 66 coupled thereto for delivering liquid fuel in proportion to the pulse width of signal FPW from controller 12. Fuel is delivered to fuel injector 66 by a fuel system (not shown) including fuel tank, fuel pump, fuel lines, and fuel rail. The engine 10 of FIG. 1 is configured such that the fuel is injected directly into the engine cylinder, which is known to those skilled in the art as direct injection. Alternatively, liquid fuel may be port injected. Fuel injector 66 is supplied operating current from driver 68 which responds to controller 12. In addition, intake manifold 44 is shown communicating with optional electronic throttle 64. In one example, a low pressure direct injection system may be used, where fuel pressure can be raised to approximately 20-30 bar. Alternatively, a high pressure, dual stage, fuel system may be used to generate higher fuel pressures.

Distributorless ignition system 88 provides an ignition spark to combustion chamber 30 via spark plug 92 in response to controller 12. Universal Exhaust Gas Oxygen (UEGO) sensor 126 is shown coupled to exhaust manifold 48 upstream of catalytic converter 70. Heated Exhaust Gas Oxygen (HEGO) sensor 127 is shown coupled to an exhaust passage downstream of catalytic converter 70. Both sensors 126 and 127 provide data to controller 12, discussed in further detail below.

Converter 70 can include multiple catalyst bricks, in one example. In another example, multiple emission control devices, each with multiple bricks, can be used. Converter 70 can be a three-way type catalyst in one example.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing force/position applied by foot 132; a measurement of engine manifold pressure (MAP) from pressure sensor 122 coupled to intake manifold 44; an engine position sensor from a Hall effect sensor 118 sensing crankshaft 40 position; a measurement of air mass entering the engine from sensor 120; and a measurement of throttle position from sensor 62. Barometric pressure may also be sensed (sensor not shown) for processing by controller 12. In a preferred aspect of the present description, engine position sensor 118 produces a predetermined number of equally spaced pulses each revolution of the crankshaft from which engine speed (RPM) can be determined.

In some embodiments, the engine may be coupled to an electric motor/battery system in a hybrid vehicle. The hybrid vehicle may have a parallel configuration, series configuration, or variation or combinations thereof.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is shown merely as an example, and that intake and exhaust valve opening and/or closing timings may vary, such as to provide positive or negative valve overlap, late intake valve closing, or various other examples.

An exhaust fuel-to-air ratio (FAR) may be controlled by providing a FAR controller that uses oxygen sensor feedback loops to determine an adjustment factor for fuel injection. In this way, fuel injection is adjusted to diagnose catalyst degradation, alter a catalyst state, and prevent states having too much reductant or too much oxidant content in the catalyst. This prevents harmful emissions, such as CO and NOx from exiting the vehicle.

Figure 2:
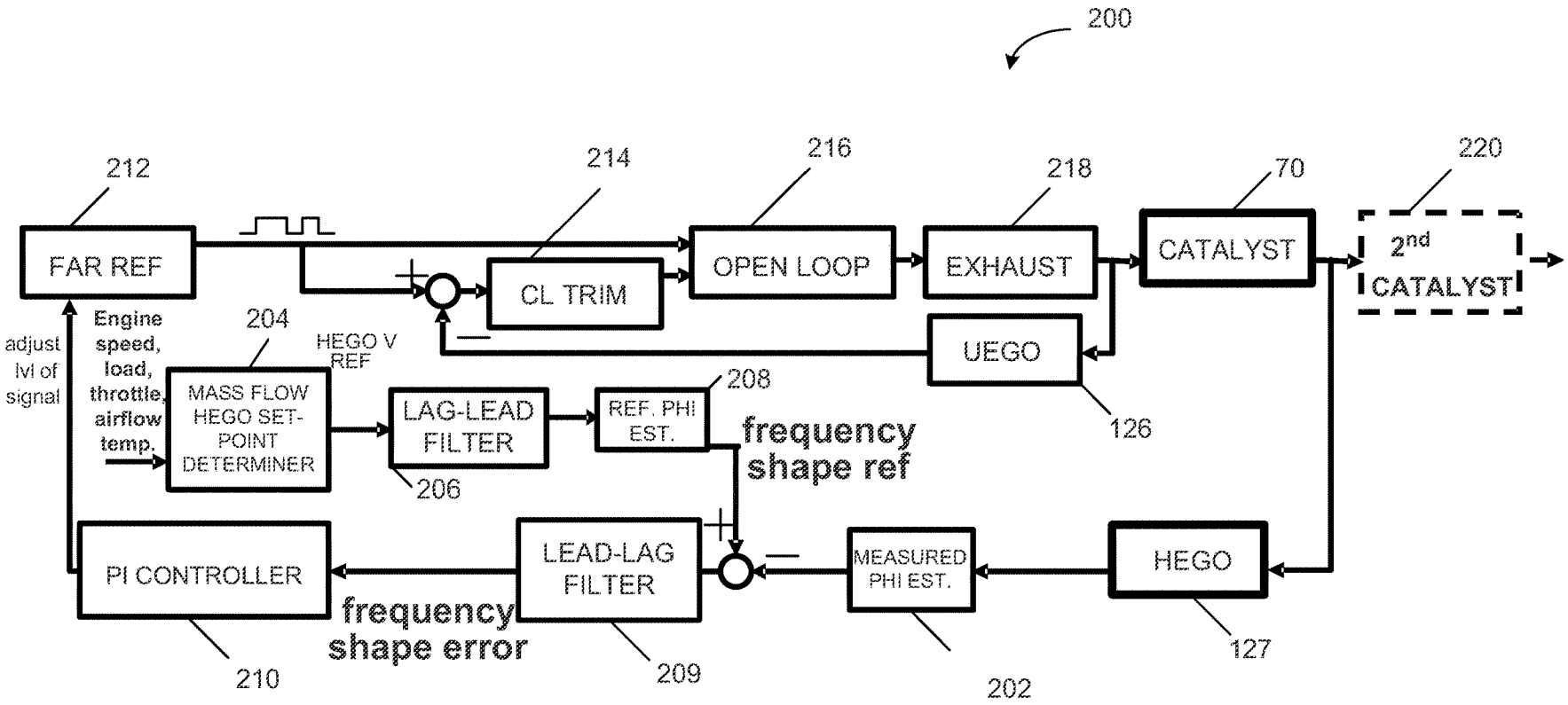
FIG. 2 shows a block diagram of a fuel-to-air ratio controller.

FIG. 2 shows a block diagram of a fuel-to-air ratio (FAR) controller 200 included in engine 10 of FIG. 1. The controller 200 maintains a desired fuel-to-air ratio by adjusting a fuel injection amount to the engine based on feedback from exhaust sensors. In one embodiment, the controller utilizes feedback from multiple sensors, oxygen sensors in this example, positioned at multiple locations along the exhaust path. The sensors may be positioned such that one sensor is located upstream of the catalytic converter, and another sensor is located downstream of the catalytic converter. In this configuration, the upstream sensor is a wide-band sensor, capable of providing a continuous wide-band estimate of FAR. In this way, the wide-band sensor can detect a large range of FAR estimates, however sacrifices preciseness. The downstream sensor, by contrast, is a narrow-band sensor, capable of performing much more precise estimates of gas stoichiometry than the wide-band sensor, but sacrificing measurable ranges. Outside of the band, the sensor signal saturates, providing the sensor a very narrow band of continuous operation.

As shown in FIG. 2, a Universal Exhaust Gas Oxygen (UEGO) sensor 126 is positioned upstream of the catalytic converter, and a Heated Exhaust Gas Oxygen (HEGO) sensor 127 is positioned downstream of the catalytic converter 70. If positioned in the pre-catalyst exhaust flow, the HEGO sensor 127 is implemented as a switch. However, when positioned in the post-catalyst exhaust, the FAR may be sufficiently filtered and centered about stoichiometry such that the HEGO sensor 127 can provide a more precise estimate of the gas stoichiometry by operating in its narrow linear band. As such, the HEGO voltage indicates both the FAR of the exhaust gas and the state of the catalyst, either in terms of relative amounts of oxidants and reductants in the catalyst 70, or in terms of the related concept of the amount of oxygen storage that is available in the catalyst 70. Each type of information regarding the state of the catalyst indicates the ability of the catalyst 70 to process incoming emissions. For example, a higher voltage indicates a depletion of oxygen storage, and a lower voltage indicates an increase in oxygen storage capability.

The positioning of the UEGO and HEGO sensors 126 and 127 creates a sensor structure that is sometimes referred to as an inner loop—the UEGO sensor loop that seeks to regulate the exhaust gas before it passes through an emission reducing catalyst 70—and an outer loop—the HEGO sensor loop that measures exhaust gas after it passes through the catalyst 70. The inner loop regulates the exhaust gas before it passes through an emission-reducing catalyst 70. The inner loop controls the feed-gas (exhaust output from the engine) FAR in order to reduce emissions, prevent a fuel economy penalty, and avoid Noise, Vibration, and Harshness (NVH) or drivability issues. The inner loop is also responsible for regulating the feed-gas FAR in order to track a target value set by the outer loop. The outer loop utilizes measurements of the exhaust gas after is passes through the catalyst 70 to determine the target value based on operating conditions and a post catalyst (HEGO) sensor voltage.

As described above, FIG. 2 illustrates one embodiment of a control system that controls an engine exhaust with an upstream sensor and a downstream sensor by adjusting a set-point for the downstream sensor based on a rate of change of air mass flow upstream of the engine and adjusting fuel injection to control exhaust fuel-air ratio (FAR) at the downstream sensor to the adjusted set-point, and to control exhaust FAR at the upstream sensor to an upstream sensor set-point. Additionally, the control system determines air mass flow changes that fall outside of a threshold range and in response calculating a rate of change of the filtered air mass flow, mapping the calculated rate of change of the filtered air mass flow into a delta HEGO set-point adjustment to determine an adjustment factor (which is further elaborated in FIG. 3 and step 412 of FIG. 4), adjusting a static set-point based on static input conditions by the adjustment factor, and setting the set-point of the HEGO to the adjusted static set-point. In this way, it is possible to enhance the capability of the outer loop controller which in turn enables enhancement of catalyst oxygen management and diagnostics.

In particular, the control system of FIG. 2 (which is further elaborated in the routine depicted in FIG. 4) uses estimated mass flow change determined upstream in the engine air induction system to dynamically pre-condition the catalyst state to absorb excessive rich or lean conditions brought on by the mass flow changes in the engine 10. The preconditioning relies on modulation of the HEGO voltage set point relative to the nominally scheduled (e.g., steady-state) value.

The block diagram of the fuel-to-air ratio controller shown in FIG. 2 depicts the feedback nature and error control of the control system. As illustrated, the control system controls the variation of the HEGO set-point and bases the set-point on static measures of mass flow, while at the same time including a transient adjustment based on dynamic mass flow conditions in order to suppress emissions by appropriate dynamic biasing of the HEGO set-point. In this way, if a lean transient and/or transition to high load is expected, the HEGO set-point, and thus the ultimate UEGO set-point and fuel injection amount, are adjusted to guide operation to lower catalyst oxygen storage.

In order to provide the above-described adjustment, a FAR reference signal provides a target FAR value for the inner UEGO loop, as configured by feedback from the outer HEGO loop. The HEGO sensor 127 provides a HEGO measured voltage using measurements taken downstream of the catalytic converter (and optionally upstream of optional $2^{nd}$ catalyst 220). This measured voltage is then converted to a normalized fuel-to-air ratio (phi) by measured phi estimator 202. Operating characteristics, such as engine speed and load (for static HEGO set-point determination) or mass flow at the throttle (for dynamic HEGO set-point determination), are input into HEGO set-point determiner 204. The determiner 204 provides a HEGO reference voltage to lag-lead filter 206, which provides a filtered reference voltage to reference phi estimator 208 in order to convert the reference voltage into a normalized fuel-to-air ratio (phi). Alternatively, the reference set-point may be based on the exhaust temperature. Lag-lead filter 206 processes the HEGO voltage set-point command to adjust the level of estimated phi in order to suppress high frequency and pass lower frequency content of the signal to provide prompt response of the system without overshoot. In this way, the HEGO step is adjusted gradually, first by reaching part of the requested step, then increasing exponentially to the full requested step value. The amount of step and exponential rate of increase is based on the dynamic characteristics of the system under closed loop control, i.e. depends on the choice of the closed loop controller 209, 210.

The difference between the measured phi and the reference phi is then determined in order to provide a frequency shaped error signal, representing the offset between the measured and reference HEGO voltage, to a Proportional-Integral (PI) controller 210. The two voltages are converted to the normalized fuel-to-air ratio (phi) because the HEGO voltage spans a much larger range for a given lean phi than for a rich phi. Therefore, converting prior to determining error ensures that the lean or rich conditions do not affect the error calculation due to the non-linear mapping of HEGO voltage to estimated phi. The lead-lag filter 209 processes the outer-loop error signal (the normalized reference HEGO set-point voltage minus the normalized measured HEGO set-point voltage), which, in opposite functionality (though not necessarily in the same frequency band) as the lag-lead filter of the HEGO reference voltage set-point command, amplifies the higher frequencies relative to the lower frequencies in order to produce more responsive but stable control over the catalyst behavior. The PI-controller 210 acts on this frequency shaped error signal to create a control command sent to FAR reference 212 in order to allow the outer loop measured HEGO voltage to influence the inner loop control.

The inner loop determines controller reaction to deviation between the post catalyst measured phi and the set-point reference phi. UEGO sensor 126 is positioned upstream of catalytic converter 70 such that it takes measurements of an exhaust stream entering catalytic converter 70, as shown in FIG. 2. The difference between this measurement and the FAR reference signal from the outer loop is calculated in order to determine an error signal, which is processed by closed loop trim controller 214. The processed error signal and FAR reference signal are then provided to open loop controller 216 in order to map the FAR to a fuel injection adjustment. The pre-catalyst exhaust 218 is then monitored by UEGO 126 to determine the controller reaction.

In this way, the downstream sensor set-point may be adjusted to account for transient operation, even if the static set-point is the same at the beginning and the end of the transient. For example, during a vehicle deceleration, where the fuel is not shut off, the FAR that enters the catalyst will sometimes not be precisely controlled and the possibility of going too rich is higher in such a maneuver. During such a transient, the system commands the catalyst oxygen storage to increase temporarily by reducing the HEGO voltage set-point so that a richer FAR can be tolerated for a longer period. A similar outer loop control action for the case of acceleration in which the open loop fuel system tends to produce leaner mixtures and higher feedgas NOx concentrations can be protected for by adjusting the HEGO voltage set-point higher and catalyst to be oxygen depleted.

In order to establish sufficiently capable outer loop control to allow for dynamic scheduling of the HEGO set point while staying within catalyst storage limits, the controller requires several features outlined in the present disclosure. First the controller takes into account several frequency modes of outer loop operation: a lower frequency response of the catalyst/HEGO (slow integrating operation that occurs when the catalyst fills or empties) and a higher frequency response in which a portion of the emission gases pass through the catalyst without engaging the catalyst oxygen storage (direct feed through). In order to avoid excessive controller action that will drive the catalyst to fully saturated or depleted states, the controller avoids overreacting to the direct feed through component. However, in order to provide fast enough response to satisfy the above dynamic set point adjustments, the slower integrating action is sped up to go from one stable integrated condition to another.

A part of the outer loop feedback design is determining controller reaction to deviation between the post catalyst phi (normalized HEGO converted from HEGO sensor voltage) and the set-point phi (normalized set-point converted from the set-point voltage). The conversion, described herein, is a nonlinear operation with hysteresis. A proportional-integral (PI) controller again presents one possibility. However, the nature of the catalyst with the internal integrating behavior (oxygen storage) and the direct feed-through limits the speed and/or accuracy of the response with the PI controller. A frequency shaping that increases the signal content in the mid frequency band, and suppresses high and low frequencies, may be used to improve the speed of response by about a factor of 2 to 3 and suppress of disturbances by a factor of about 4 while maintaining good stability and robustness.

As a result of the aggressiveness of the feedback controller, the response to the command may suffer overshoots.

Specifically, the response to the command signal's high frequency content could lead to the catalyst reaching an oxygen storage limit (fully filled or depleted) which in turn would cause a breakthrough of CO or NOx. A step command, a typical result of an operating adjustment made by scheduling the command based on other vehicle conditions, will excite an overshoot in the response. An effective approach to reduce the problem is to lag-lead filter (a type of frequency shaping) the command in block 206, which effectively allows part of the step to be passed, but then merely allows the remaining portion of the step to approach the final value of the step as an exponential decay. The system immediately responds to the partial step. System overshoot will merely reach the original desired step value under these conditions. The remaining command signal that slowly builds up then forces the system to remain near the desired value.

Additionally, certain physical characteristics of the HEGO sensor that relate FAR into a HEGO output voltage create distortion in regard to rich and lean FAR. This can lead to non-linear gain distortion and can be corrected. An issue arises from translating HEGO voltage to an estimate of normalized fuel-air ratio. The HEGO voltage spans a much larger range for a given lean phi than for a rich phi. This method converts the HEGO voltage set point and the HEGO measurement individually into the normalized fuel-air ratio before computing the error (difference between the two signals). This may appear to be equivalent to simply taking the conversion of the voltage error signal, but due to the non-linear mapping of the HEGO voltage to estimated phi, a voltage error signal at a given numerical value will have a different meaning in phi when lean versus rich, therefore the command and measured HEGO voltages are determined first and then the difference is taken to determine phi.

In addition, catalyst diagnostics can also be included in one embodiment. Here, to periodically determine catalyst storage capacity, the routine introduces set-point changes for the post-catalyst HEGO voltage to exercise the catalyst within very strict limits (elaborated in step 420) taking control of the output of the block 204 in FIG. 2. The control refinements described with respect to FIG. 4 reduces the potential for overfilling or depleting the catalyst oxygen storage during the transitions, so that the intrusive set-point modulation does not produce undesired emissions. Accordingly, FIG. 4 shows a flow diagram of method 400 for determining a HEGO set-point based on operating conditions of the engine 10.

Figure 3:
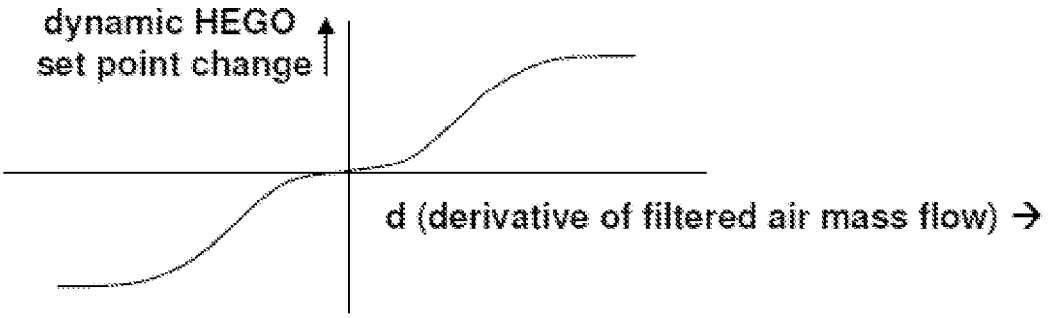
FIG. 3 shows an example of mapping the derivative of mass airflow to a dynamic HEGO set-point.

The method 400 begins by detecting air mass flow at the throttle at step 402 and filtering that air mass flow at step 404 so as to eliminate small fluctuations that are not part of a large transient air mass. Step 406 checks if the catalyst monitor function has been run to completion yet for this drive (moncompflg=1). If it has, then the method proceeds to the right flow path, identified by arrow 408, in which a determination of the HEGO set-point is performed based on dynamic conditions of engine 10. In this case, if the change in air mass is significant enough to pass through the low-pass filter, then the rate of change is calculated in step 410 of method 400. This rate of change is mapped into a delta HEGO set-point adjustment at step 412 of method 400. An example of this mapping is shown in FIG. 3, in which the input on the X horizontal axis is the derivative d of the mass air flow, and the output on the vertical Y axis is the dynamic HEGO set-point. Small air flow rates of change, near the origin the X-Y axis, provide very small HEGO set point changes to avoid chattering in HEGO set-point value; intermediate to large derivatives create larger dynamic HEGO set points; but truly excessive derivatives reach a limit of dynamic HEGO set point change since there is a limit to HEGO linear operating range. The HEGO set-point that was calculated based on static input conditions, such as engine speed, load, temperature, etc., is determined at step 414. The delta HEGO set-point adjustment determined in step 412 is then added to the static HEGO set-point in step 416 of method 400 in order to determine the dynamic adjustment factor. Step 417 is a final clip on the sum of the static and dynamic set point changes, to make sure that the catalyst is not driven to full depletion or saturation. In step 418, the outer loop HEGO set-point is made available to 204 so that the feedback fuel control system may then use this new HEGO set-point.

Figure 4:
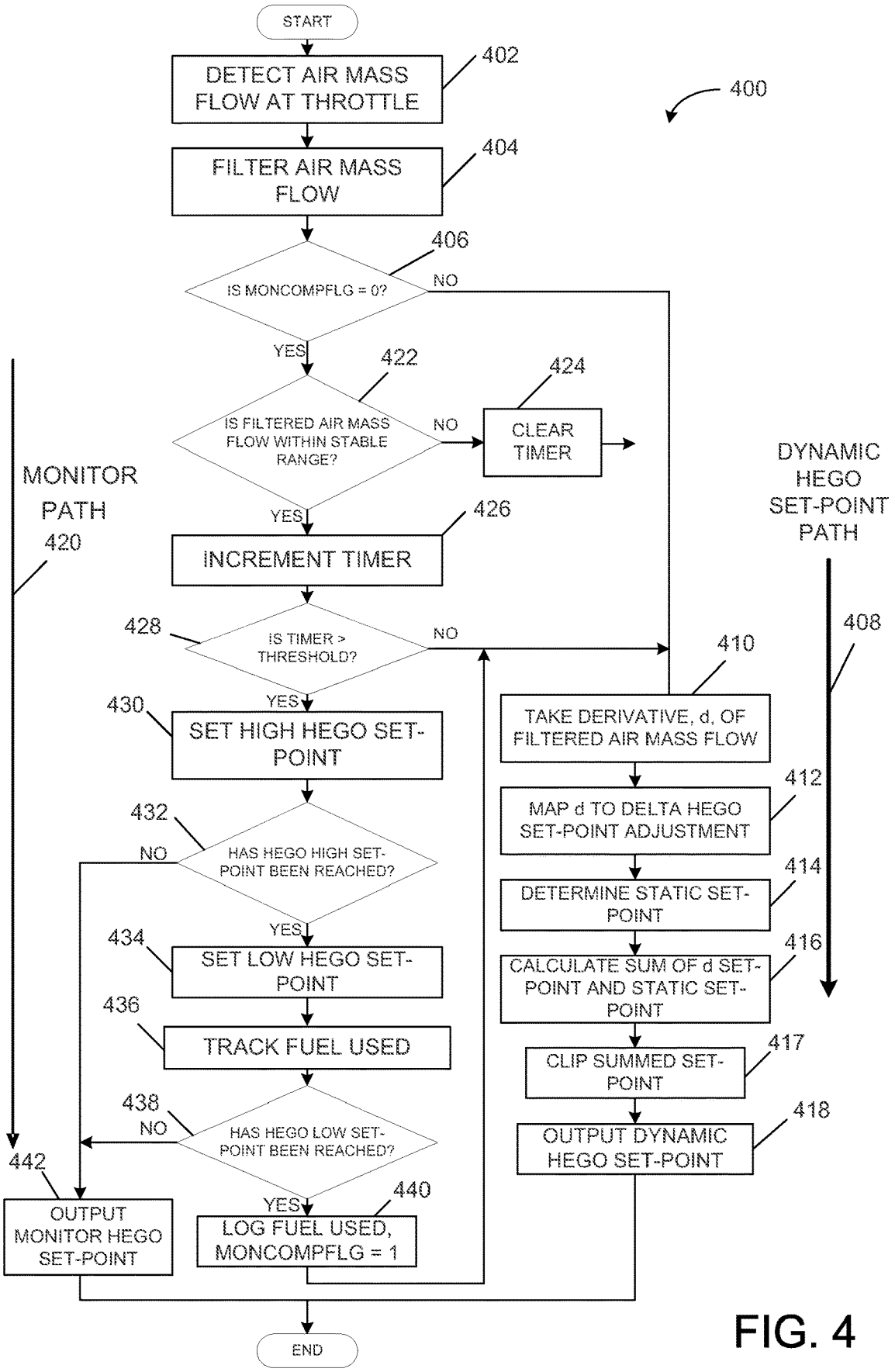
FIG. 4 shows a flow diagram of HEGO set-point determination based on operating conditions of the engine of FIG. 1.

If, at step 406 of method 400, it is determined that the catalyst monitor has not run to completion (moncompflg=0), the method proceeds along the left flow path, identified as monitor path 420 in FIG. 4. This path monitors the catalyst's oxygen storage capacity and is dependent on refined feedback control of the outer loop, so that the HEGO voltage does not exceed an upper or lower voltage that would allow regulated emissions to pass to the tail pipe. This flow path is dependent on the engine 10 operating for the duration of the test in relative steady state. Continuing with method 400, in step 422, the filtered air mass at the throttle is now used as part of a check to determine if conditions are stable. Accordingly, the current calculated (from step 402 of method 400) throttle air mass is evaluated to determine if it is remaining within a delta, or threshold range, above and below the filtered current value (from step 404 of method 400). If it is determined that the throttle air mass flow is not within the delta of the filtered air mass flow, a timer (described in more detail below) is cleared and the dynamic set-point flow path 408, described above, is followed.

If, however, it is determined that the throttle air mass flow is within the delta of the filtered air mass flow, a timer is incremented (by the delta time of the iteration loop) at step 426. At step 428, the timer value is compared to a time threshold to determine whether the timer has advanced to a sufficient time, indicating a sufficient air mass stability. The allowance of small perturbations of the filtered air mass allows the monitor to potentially run even if the engine is not completely at steady state operation. If the timer is not above a threshold, the method waits to start the monitoring process and allows the dynamic HEGO set-point process to continue to run. If, at step 428, the timer has reached the threshold, the HEGO set-point is placed at a high value in step 430, more particularly, a voltage indicating that the catalyst 70 is near oxygen depletion (but not high enough to allow CO breakthrough). If the high HEGO set-point is determined to be achieved by the feedback fuel controller at step 432, then the method 400 proceeds to step 434, where the HEGO set-point is stepped to a lower value, that would indicate that the catalyst 70 is near oxygen saturation. If the high HEGO set-point has not been reached then the method proceeds to 442 and sends the high HEGO set-point to 204.

The amount of reduced fuel (from the fuel expected based on stoichiometry estimations) is tracked and accumulated each iteration loop so that the fuel used to match the lower HEGO set-point is determined in step 436 of method 400. In 438, if the set-point has not been reached yet, then the method proceeds to 442 and the lower HEGO set point is sent to determiner 204. Once the set point is reached, the system is returned to normal drive operation in 440, for instance by setting a monitor completion test flag to 1. If for some reason, such as a large driver-induced throttle change, the test is interrupted, then the timer is cleared and the method 400 restarts. The amount of reduced fuel needed to move the HEGO voltage from high to a low voltage set-point is normalized for flow conditions and then can be compared to the known (determined offline) results of the catalyst capacity for new, intermediate, fully aged, and threshold (a catalyst that has exceeded its full useful life) catalysts, thus producing an indication of the current catalyst's relative capacity.

Accordingly, the routine described in method 400 exercises the catalyst through a part of its storage capacity. Such a test (expected to run once per drive cycle) can be run during relatively stable engine conditions, such as idle or cruise. In this way, during selected conditions, the downstream sensor set-point is adjusted transiently and independently of operating conditions over a range within a maximum voltage and a minimum voltage, identifying catalyst degradation based on a response to adjusting the set-point. The amount of fuel used to move from one HEGO set-point to another can be determined for new and aged catalysts and on a vehicle can be measured and compared to these indicators. This advantageously utilizes the prompt and stable control of the outer loop, enabled by frequency shaping the HEGO set point and error values as shown in FIG. 2, in which the desired set-point can be reached promptly without overshooting enough to create emissions.

Figure 5A:
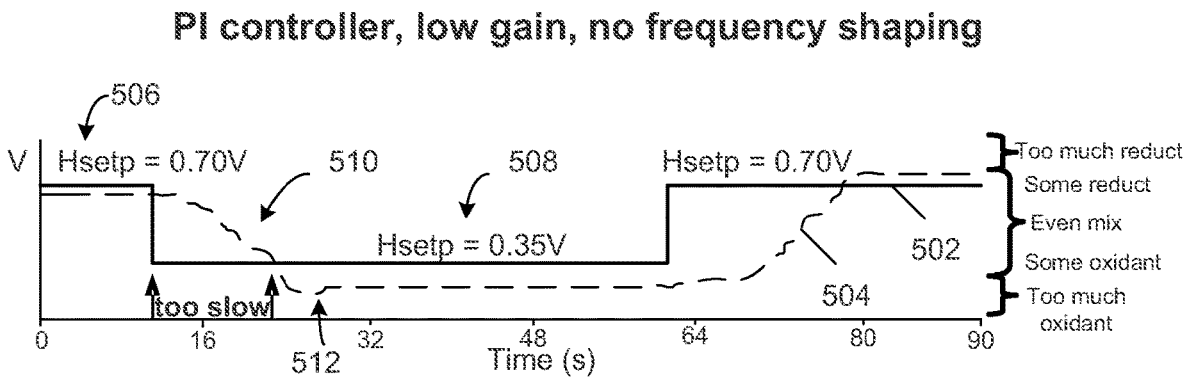
FIGS. 5A-5C show HEGO set-point change over time in response to command signals provided by various PI controller types of the feedback fuel controller of FIG. 2.
Figure 5B:
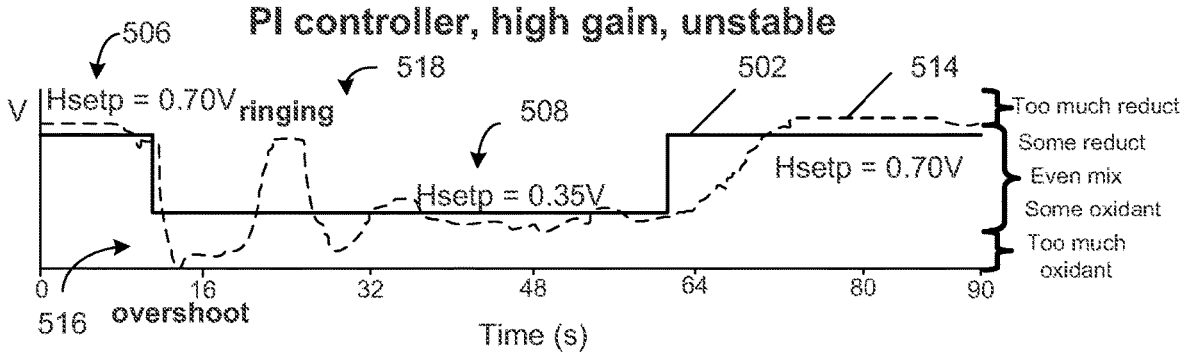
Figure 5C:
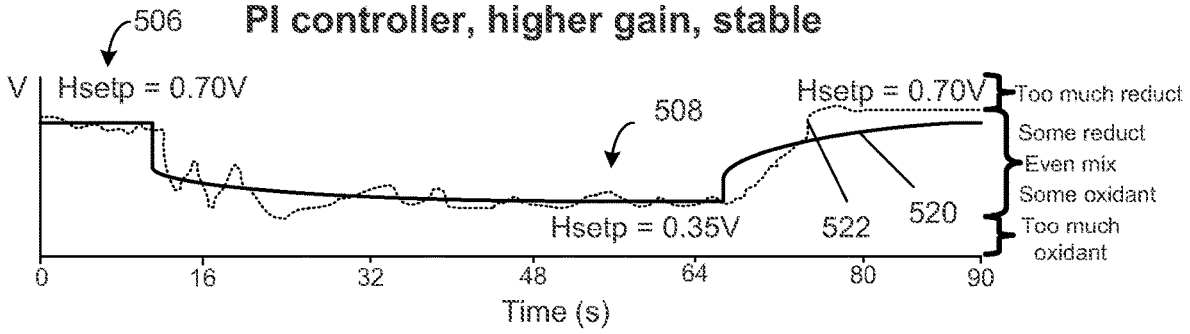

FIGS. 5A-5C show examples of HEGO set-point control using various controller types. In each of the figures, line 502 (and line 520 in FIG. 5C) represents the command to set the HEGO set-point and lines 504, 514, and 522, respectively, represents the HEGO voltage response to the post-catalyst exhaust gas. In each case of FIGS. 5A-5C, the HEGO set-point is stepped from 0.7 volts at 506 (this indicates that the catalyst 70 has oxygen storage at a low end of its range—that there are more reductants than oxidants coming out of the catalyst) to a set-point of 0.35 volts at 508 (this indicates that the catalyst 70 is nearing oxygen storage saturation—that there are more oxidants than reductants coming out of the catalyst). Exceeding these voltages in either direction results in either CO or NOx passing on to the tailpipe.

FIG. 5A is a typical low gain proportional-integral (PI) controller that, as shown, has difficulty responding to the change in command, both in terms of time (510) and overshoot (512). The practical limits of the present disclosure require that the response occur within less than a second to have an emission or diagnostic benefit. Moreover, the voltage overshoots in both directions, indicating that the oxygen storage was saturated or depleted more than intended for a prolonged period of time. Increasing the PI gains any further for this example will only make the overshoots worse.

FIG. 5B increases the gain in comparison to the PI controller of FIG. 5A. There is no set-point frequency shaping used in the controller of FIG. 5B in order to reach its level of control, although error frequency shaping is used. This plot illustrates that even if prompt enough response is achieved, maintaining the set-point could still be an issue. The initial overshoot (516) and ringing (518) outside the operational region of catalyst 70 are not advantageous.

FIG. 5C illustrates the catalyst response when using a PI controller with higher gain than those of FIGS. 5A (5C has the same PI gain as 5B), in which both error and command signals are frequency shaped. The response to HEGO set-point changes is prompt and keeps the catalyst 70 in its relatively efficient operating region. The curved nature of the command 520 indicates that the commanded HEGO step is adjusted by lead/lag filtering in which the step merely reaches part of the full step and then exponentially approaches the final value. The amount of step and exponential rate of increase is based on the dynamic characteristics of the closed loop system.

It will be appreciated that the configurations and methods disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for controlling an engine exhaust with an upstream sensor and a downstream sensor, comprising:

adjusting a set-point for the downstream sensor based on a rate of change of air mass flow upstream of an engine;

comparing a measured exhaust reading from the downstream sensor to the set-point to generate an error, and determining a feedback correction from the error with a feedback controller; and adjusting fuel injection to control exhaust fuel-air ratio (FAR) at the downstream sensor to the adjusted set-point based on the feedback correction, and to control exhaust FAR at the upstream sensor to an upstream sensor set-point, wherein the upstream sensor is a wide-band oxygen sensor and the downstream sensor is a narrow-band oxygen sensor, wherein the adjusted set-point is further adjusted by a frequency shaping filter that suppresses higher frequencies and passes lower frequencies, and wherein the comparison to generate the error is determined after applying the frequency shaping filter to the adjusted set-point.

2. The method of claim 1, wherein the upstream sensor is a Universal Exhaust Gas Oxygen (UEGO) sensor and the downstream sensor is a Heated Exhaust Gas Oxygen (HEGO) sensor, the adjusting of the set-point including mapping, with a map, a calculated rate of change of a filtered air mass flow into a delta HEGO set-point adjustment, the mapping including where smaller air flow rates of change, near zero, provide smaller HEGO set point changes, intermediate to large air flow rates of change create larger dynamic HEGO set point changes, and even larger air flow rates of change provide smaller HEGO set point changes.

3. The method of claim 2, wherein a set-point for a UEGO sensor loop is decreased when an amount of reductants in the exhaust estimated by a post-catalyst HEGO sensor exceeds a predetermined threshold and the set-point for the UEGO sensor loop is increased when an amount of oxidants in the exhaust estimated by the post-catalyst HEGO sensor exceeds a predetermined threshold.

4. The method of claim 2, wherein a set-point for a UEGO sensor loop is not changed when an amount of oxidants and reductants in the exhaust estimated by a post-catalyst HEGO sensor does not exceed a predetermined threshold.

5. The method of claim 2, wherein a set-point for a HEGO sensor loop is adjusted in response to a change in mass flow of the engine.

6. The method of claim 5, wherein the set-point for the HEGO sensor loop is decreased when the engine mass flow rapidly decreases and the set-point is increased when the engine mass flow rapidly increases.

7. The method of claim 2, wherein a set-point for a HEGO sensor loop is adjusted when the rate of change of air mass flow is greater than a threshold.

8. The method of claim 7, further comprising, determining an operating condition by detecting air mass flow at a throttle and passing the detected air mass flow through a low-pass filter to obtain the filtered air mass flow, a first operating condition being determined when the air mass flow is within a threshold range of the filtered air mass flow and a second operating condition being determined when the air mass flow is outside of the threshold range of the filtered air mass flow.

9. The method of claim 8, further comprising, during the first condition, advancing a timer when the air mass flow is determined to be within the threshold range of the filtered air mass flow, and placing the set-point of the HEGO sensor loop to a first voltage when the timer exceeds a time threshold.

10. The method of claim 9, further comprising, during the first condition, placing the set-point of the HEGO sensor loop to a second voltage, wherein the second voltage is lower than the first voltage.

11. The method of claim 8, further comprising, during the second condition, calculating the rate of change of the filtered air mass flow, mapping the calculated rate of change of the filtered air mass flow into the delta HEGO set-point adjustment to determine an adjustment factor, adjusting a static set-point based on static input conditions by the adjustment factor, and setting the set-point of the HEGO sensor to the adjusted static set-point.

12. A method for controlling an engine exhaust with an upstream sensor and a downstream sensor, comprising:

adjusting a set-point for the downstream sensor based on a rate of change of air mass flow upstream of an engine;

comparing a measured exhaust reading from the downstream sensor to the set-point to generate an error, and determining a feedback correction from the error with a feedback controller; and adjusting fuel injection to control exhaust fuel-air ratio (FAR) at the downstream sensor to the adjusted set-point based on the feedback correction, and to control exhaust FAR at the upstream sensor to an upstream sensor set-point, wherein a control signal for adjusting the set-point for the downstream sensor is passed through a lag-lead filter and a control signal for adjusting the fuel injection is passed through a lead-lag filter.

13. A method of controlling fuel injection in an engine comprising:

determining a fuel-to-air ratio (FAR) of an exhaust stream at a first oxygen sensor loop positioned upstream of a catalytic converter and at a second oxygen sensor loop positioned downstream of the catalytic converter;

determining a downstream set-point based on operating conditions;

adjusting the downstream set-point based on a rate of change of mass flow upstream of the engine;

converting the adjusted downstream set-point to FAR;

determining an error between the adjusted downstream set-point FAR and a measured downstream FAR;

determining an upstream set-point based on the determined error; and adjusting fuel injection based on the upstream set-point and measured upstream FAR;

wherein an upstream sensor is a Universal Exhaust Gas Oxygen (UEGO) sensor, and a downstream sensor is a Heated Exhaust Gas Oxygen (HEGO) sensor, the adjusting of the downstream set-point including mapping, with a map, a calculated rate of change of a filtered air mass flow into a delta HEGO set-point adjustment, the mapping including where smaller air flow rates of change, near zero, provide smaller HEGO set-point changes, intermediate to large air flow rates of change create larger dynamic HEGO set-point changes, and even larger air flow rates of change provide smaller HEGO set-point changes.

14. The method of claim 13, wherein a HEGO sensor set-point is decreased when engine mass flow is rapidly decreased and the HEGO sensor set-point is increased when the engine mass flow is rapidly increased.

15. The method of claim 13, further comprising determining a selected operating condition by detecting air mass flow at a throttle and passing the detected air mass flow through a low-pass filter to obtain the filtered air mass flow, a first operating condition is determined when the air mass flow is within a threshold range of the filtered air mass flow and a second operating condition is determined when the air mass flow is outside of the threshold range of the filtered air mass flow.

16. The method of claim 13, further comprising processing a HEGO set-point adjustment command by lag-lead filtering the command.

17. A method of diagnosing catalyst degradation in an engine comprising:

determining a fuel-to-air ratio (FAR) of an exhaust stream at a universal exhaust gas oxygen (UEGO) sensor positioned upstream of a catalytic converter and at a heated exhaust gas oxygen (HEGO) sensor positioned downstream of the catalytic converter;

adjusting a set-point for a HEGO sensor loop based on a rate of change of mass flow upstream of the engine;

adjusting fuel injection to control the FAR to match desired set-points; and during selected conditions, adjusting a downstream sensor set-point transiently and independently of operating conditions over a range within a maximum voltage and a minimum voltage, identifying catalyst degradation based on a response to adjusting the set-point.

18. The method of claim 17, wherein a first set-point adjustment and a last set-point adjustment are offset from the maximum and minimum voltages by at least a threshold amount.

* * * * *